US005584259A

United States Patent [19]

Namur

[11] Patent Number: 5,584,259

[45] Date of Patent: Dec. 17, 1996

[54] LENGTHWISE ADJUSTABLE FORKED BOOM FOR SURFBOARDS

[75] Inventor: Marc Namur, Weiterstadt, Germany

[73] Assignee: Fanatic Sports GmbH, Ransbach-Baumbach, Germany

[21] Appl. No.: 518,277

[22] Filed: Aug. 23, 1995

[30] Foreign Application Priority Data

Aug. 23, 1994 [DE] Germany ..... 9413377 U

[51] Int. Cl.[6] ..... B63B 15/00

[52] U.S. Cl. ..... 114/97

[58] Field of Search ..... 114/39.2, 89, 90, 114/96, 97, 98, 99

[56] References Cited

U.S. PATENT DOCUMENTS

| | | | |
|---|---|---|---|
| 4,562,787 | 1/1986 | Adamek et al. | 114/97 |
| 4,867,091 | 9/1989 | Arisato et al. | 114/97 |
| 5,193,476 | 3/1993 | Namur | 114/97 |

FOREIGN PATENT DOCUMENTS

| | | | |
|---|---|---|---|
| 0071220 | 2/1983 | European Pat. Off. . | |
| 0173968 | 3/1986 | European Pat. Off. . | |
| 173968 | 3/1986 | European Pat. Off. | 114/97 |
| 0317661 | 5/1989 | European Pat. Off. . | |
| 317661 | 5/1989 | European Pat. Off. | 114/97 |
| 3125806 | 1/1983 | Germany . | |
| 9013143.6 | 2/1991 | Germany . | |
| 9107725.7 | 10/1991 | Germany . | |
| WO88/09743 | 12/1988 | WIPO . | |

*Primary Examiner*—Stephen Avila
*Attorney, Agent, or Firm*—Young & Thompson

[57] ABSTRACT

A lengthwise adjustable forked boom for surfboards comprises two principal bars (1) bound by a forked boom head piece and two extension bars (3) telescopically adjustable in them. The extension bars are interconnected at the leech by a forked boom tail piece. At the end of both principal bars (1) is a connecting bush (6) that extends beyond the bar ends, attached securely with a catch lever (7) that has locking bars (8) which lock into the corresponding adjustment holes (9) in at least one series of holes at equal intervals in the extension bars (3) when the lever (7') is closed.

5 Claims, 3 Drawing Sheets

Figure 1:
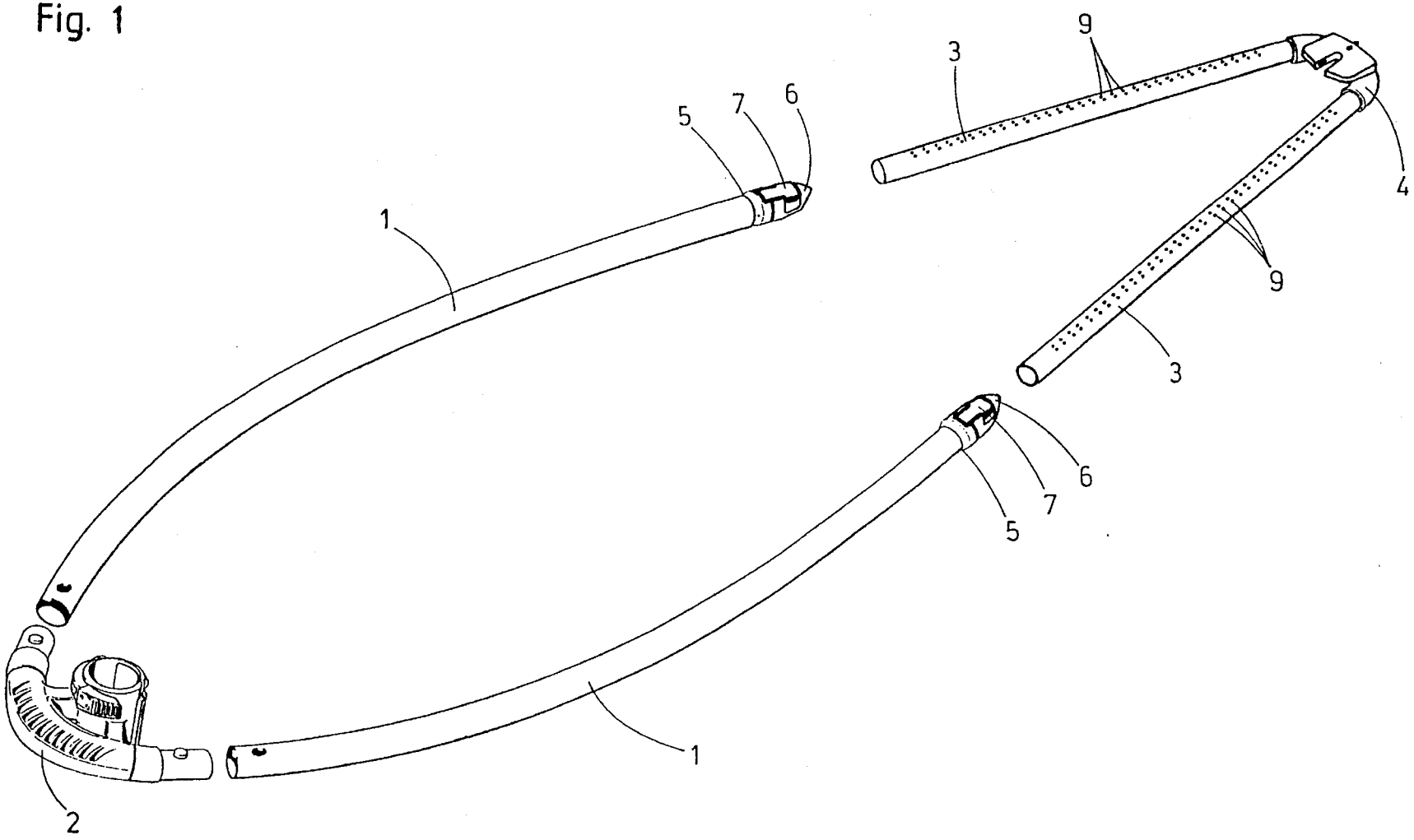

Fig. 2
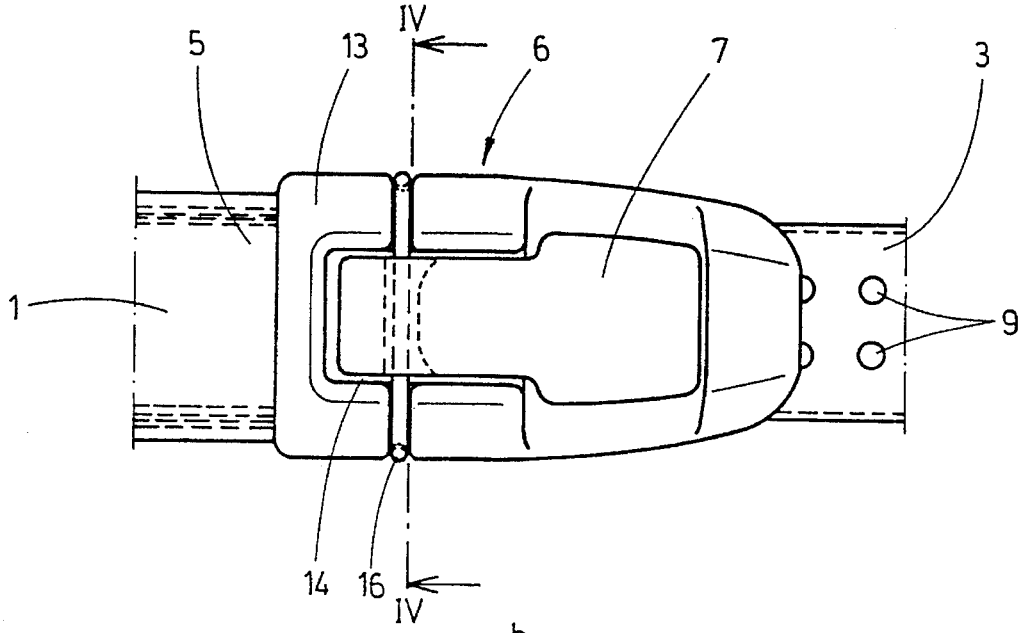
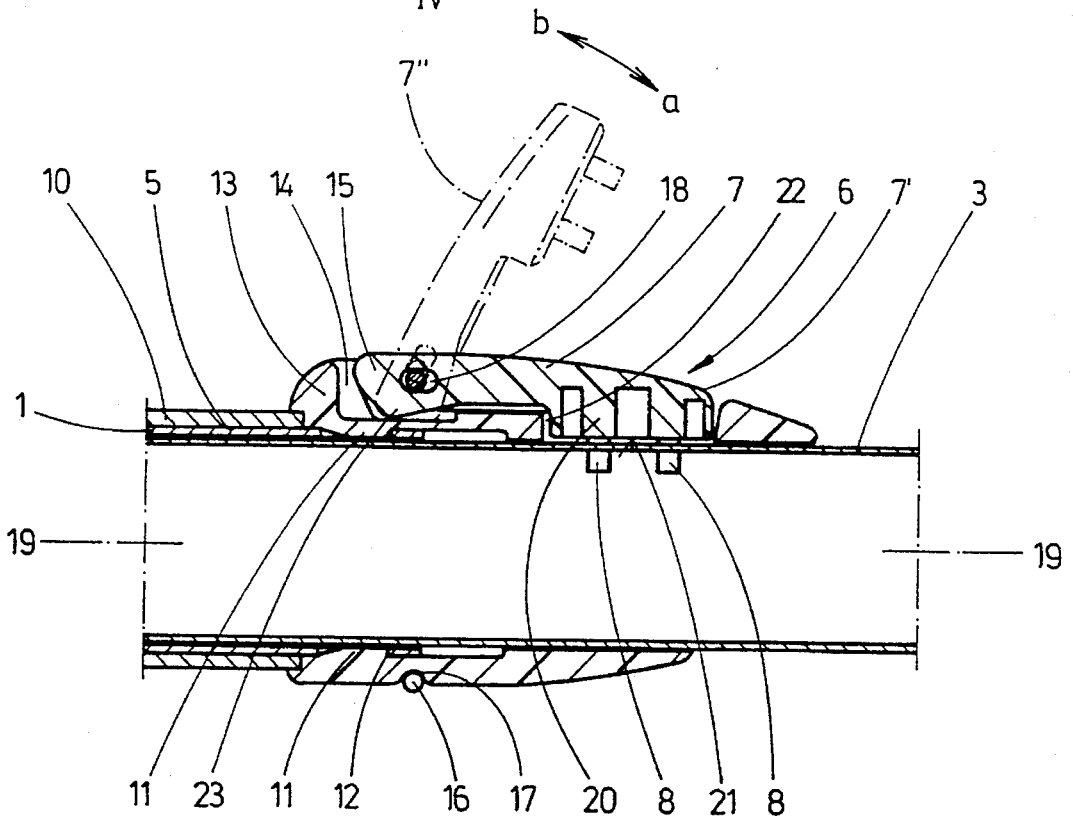
Fig. 3

LENGTHWISE ADJUSTABLE FORKED BOOM FOR SURFBOARDS

The invention concerns a lengthwise adjustable forked boom for surfboards with two principal bars connected by a forked boom head piece and two extension bars telescopically adjustable in them that are interconnected on the trailing ends by a forked boom tail piece and devices to lock the bars at the length of the forked boom adjusted according to the sail size.

In a lengthwise adjustable forked boom of this type known from EP O 317 661, an inside bush, which has axially extending snap-in pins with clamping sections that extend radially outwards, is securely attached to each end of the principal bars, whereby snap-in ring segments that extend radially inward and run circumferentially are formed on the ends of the snap-in pins. To lock the principal bars with the extension bars, outside bushes with inner screw threads are screwed into the inside bushes having a corresponding outside screw thread and whose snap-in pins are pressed together while screwing the outside bushes formed as split taper sockets so that the snap-in ring segments formed on the snap-in pins lock into place in grooves arranged circumferentially at intervals on the extension bars.

The seat trapezes that are predominately used today on surfboards place strong demands on the torsion of the forked boom so that, according to EP O 317, 661, the danger exists that the meshed screw threads of the inside and outside bushes will jam when locking the forked boom, and consequently can only be freed with great strength and often only with the aid of tools. Furthermore, the known locking device is relatively demanding and inconvenient to handle.

DE 90 13 143.6 U1 describes a lengthwise adjustable forked boom with a device to lock the extension bars to the principal that has an inside bush securely attached to each end of the principal bar via snap-in pins with snap-in ring segments extending axially over the end of the principal bar and an outside bush formed as a split taper socket. The end of the inner bush attached to the end of the principal bar has a band with a flat serration, and the outside bush's sliding end has a corresponding complementary serration. To lock the extension bars in the principal bars the outside bushes sitting loosely on the extension bars are pushed into the inside bushes, whereby the snap-in ring segments snap into the snap-in pins of the inside bushes in the designated circumferential grooves of the extension bars, and the serrations of the inside and outside bush mesh. The locks are released by turning and unscrewing the outside bushes.

The potential jamming of the screw threads of the inside and outside bushes when locking the forked boom according to EP O 317 661 A1 cannot occur when locking the extension bars of a forked boom of the type known from DE 90 13 143.6 U1, but the danger does exist that the turn-lock fastener of the lock will loosen under strong torsional forces on the forked boom, and the turn-lock fastener will open in sailing maneuvers, especially at the neck.

The task of the invention is to improve the generic class of forked booms for surfboards with respect to greater functional safety and a constructive simplification of the lock of extension bars to the principal bars.

The forked boom according to the invention makes possible a closely stepped lengthwise adjustment of the bars for trimming the sails. The catch levers of the connecting bushes, which are attached solidly to the principal bars, guarantee a safe locking of the principal bars in the extension bars when in closed position with the bar length adjusted to the corresponding sail size with the four locking bars locked into place in two holes each of two series of holes in the extension bars and prevent a mutual turning of the principal and extension bars through torsional force on the forked boom. The catch levers offer optimal lock safety against unintentional opening in sailing maneuvers, especially at the necks. The simple, stable design of the catch lever with several locking bars guarantees a safe functioning of the lock even when fouled.

The invention is explained in what follows through the use of drawings of a working example. There is shown FIG. 1 is a perspective exploded view of the forked boom according to the invention, FIG. 2 is a top view of the locking device for a principal bar and extension bar of the forked boom, FIG. 3 is a longitudinal section of the locking device, and FIG. 4 is a cross section of the locking device on line IV—IV of FIG. 2.

The forked, boom according to FIG. 1 essentially consists of two principal bars 1 that are attached to one another at an acute angle on the mast side by a forked boom head piece 2 and two extension bars 3 that fit telescopically in the principal bars 1 and are attached to one another on the sailing side via a forked boom end piece 4.

The forked boom is fastened to the forked boom head piece 2 at the mast of a surfboard and held together by the bracing of the sail, which runs from the clew of the sails to the end piece of the forked boom 4.

Figure 4:
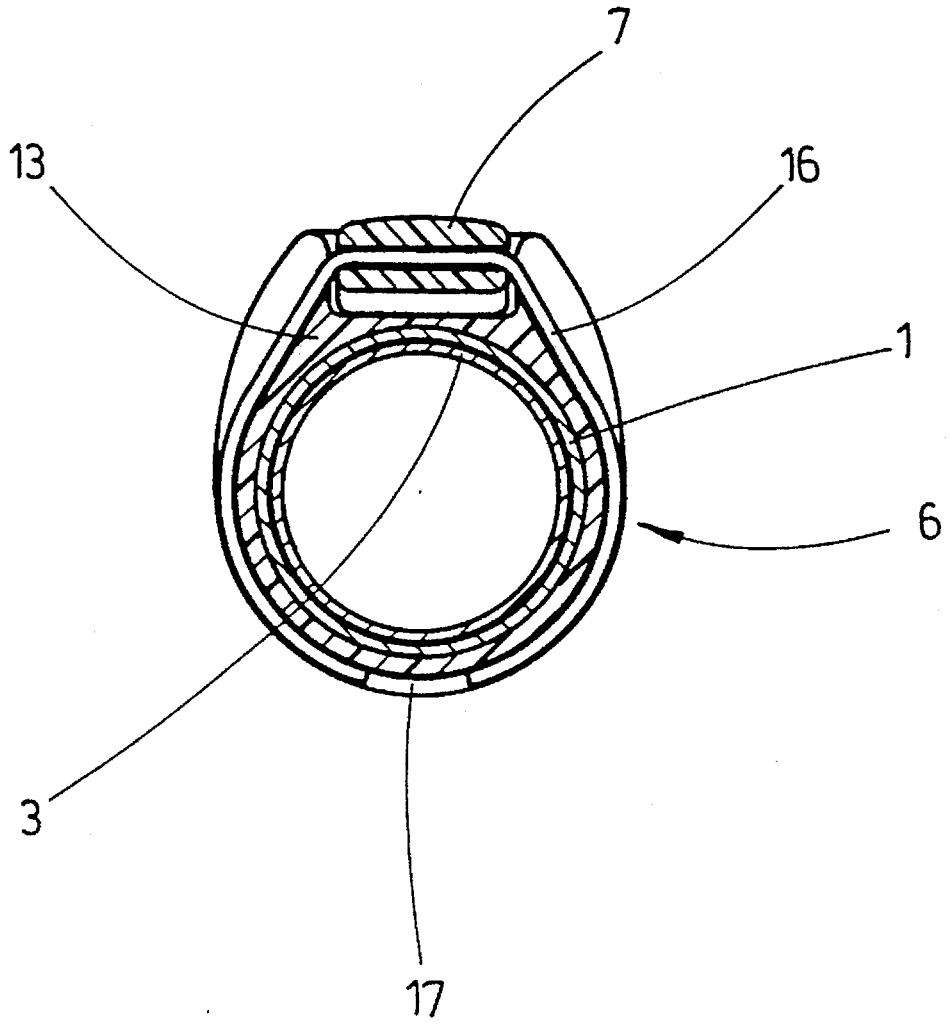

The device according to FIGS. 2 and 4 for locking the extension bars 3 to the principal bars 1 with the length of the forked boom adjusted correspondingly to the sail size, has a connecting bush 6 secured to each of the ends 5 of the principal bars 1 extending beyond the bar end with a catch lever 7 to which four locking bars 8 are attached that snap into the extension bars 3 in the corresponding holes 9 of two series of holes at equal intervals when the level 7' is closed.

The connecting bushes 6, made of injection molded plastic and pressed onto the ends 5 of both of the principal bars 1 made of aluminum and provided with a coating 10 for a safe grip, lock into the flat locking lugs 11 in the corresponding holes 12 in the principal bars 1.

The catch lever 7 is set sunk in a recess 14 in a flat projection 13 of each connecting bush 6 and attached thereto, allowing it to swivel in the direction of the bush longitudinal axis 19—19 with the end turned toward the principal bars 1 having a clip 16 of spring steel wire disposed in a circumferential groove 17 of the connecting bush 6 and passing through an elongated hole 18 in the locking end 15 of the level 7. The catch lever has a projection 20 on its free end with a concavely bent inner side 21 of cylindrical form like the extension bar 3, in which the four locking bars 8 are inserted at intervals lengthwise of and transversely to the lever 17.

The catch level 7 locks into the locked position 7' with the projection 20 in a corresponding opening 22 in the connecting bush 6 in a way such that the four locking bars 8 pass through the adjustment holes 9 in the extension bar 3 corresponding to the adjusted length of the forked boom.

The connecting bushes 6 are tapered for insertion into the extension bar 3, and the shape of the catch lever 7, which can swivel in the connecting bushes 6, is matched to the contour of the connecting bushes.

On the inner side of the attachment end 15 of the catch lever 7, a nose 23 is formed that performs the following function: by swinging the catch lever 7 manually in the direction of arrow a from open position 7" into closed position 7' in the connection bush 6, the spring clip 16 for attaching the lever 7 to the bush 6 though the nose 23 is briefly stressed so that the lever 7 latches automatically into the closed position 7' through the effect of the locking pressure caused by the spring clip 16. Upon the unintended opening of the catch lever 7 in arrow direction b during a sail maneuver, the taut spring clip 16 exerts a counter force through the nose 23 to maintain the closed position 7' of the catch lever 7.

I claim:

1. In a lengthwise adjustable forked boom for surfboards with two principal bars interconnected by a forked boom head piece and two extension bars telescopically adjustable in said principal bars, said extension bars being interconnected on the trailing side of a forked boom tail piece, and means to lock the bars at a length of the forked boom that is adjusted according to the sail size; the improvement comprising a connecting bush (6) securely attached at the end of each of the principal bars and extending beyond the bar end in a catch lever (7), said catch lever (7) having locking bars (8) that lock into place in the extension bars (3) in corresponding adjustment holes (9) of at least one series of holes set at equal intervals, when the lever (7) closed, the catch lever (7) being set sunk in a recess (14) in a flat projection (3) of the connecting bush (6) and being attached to the bush (6) so it can swivel with its end (15) turned toward the principal bar (1) and has on its free end a projection (20) with locking bars (8) that (20) locks in the closed position (7') of the catch lever (7) in a respective opening (22) in the connecting bush (6) in such a way that the locking bars (8), which are inserted into the inner side (21) of the lever projection (20) and are shaped concavely so they correspond to the cylindrical shape of the extension bars (3), pass through said adjustment holes (9) in the extension bar (3) corresponding to the adjusted length of the forked boom, the catch lever (7) being pivotally attached to the connecting bush (6) with a clip (16) of spring steel wire that is disposed in a circumferential groove (17) in the connecting bush (6) and which passes through an elongated hole (18) in the attachment end (15) of the catch lever (7).

2. Forked boom according to claim 3, further comprising a nose (23) formed on the inner side at the attachment end (15) of the catch lever (7) for the momentary tensioning of the spring clip (16), which produces a locking pressure when the catch lever (7) is closed, and for guaranteeing that the catch lever does not open unintentionally.

3. Forked boom according to claim 1, comprising four said locking bars (8), which are inserted in the catch levers (7) at intervals in the longitudinal and transverse direction of the catch levers (7), and two parallel series of corresponding adjustment holes (9) in the extension bars (3).

4. Forked boom according to claim 1, wherein said connecting bushes (6) are tapered at a sliding end for insertion into the extension bars (3), and the shape of the catch lever (7) that swivels in the connecting bushes is matched to the contour of the connecting bush (6).

5. Forked boom according to claim 1, wherein the connecting bushes (6) and catch lever (7) for the extension bars (3) are of injection-molded plastic.

* * * * *